US008424505B2

(12) United States Patent
Nagy

(10) Patent No.: US 8,424,505 B2
(45) Date of Patent: Apr. 23, 2013

(54) VARIABLE-VOLUME ROTARY DEVICE, AN EFFICIENT TWO-STROKE SPHERICAL ENGINE

(75) Inventor: Zoltán Nagy, Ajka-Bakonygyepes (HU)

(73) Assignees: Zoltan Nagy, Ajka-Bakonygyepes (HU); Richard Nagy, Ajka-Bakonygyepes (HU); Melinda Tothpal-Dementer, Budapest (HU); Gabor Mester, Budapest (HU); Tamas Kiss, Budapest (HU)

( * ) Notice: Subject to any disclaimer, the term of this patent is extended or adjusted under 35 U.S.C. 154(b) by 492 days.

(21) Appl. No.: 12/681,519

(22) PCT Filed: Sep. 29, 2008

(86) PCT No.: PCT/HU2008/000110
§ 371 (c)(1),
(2), (4) Date: Apr. 29, 2010

(87) PCT Pub. No.: WO2009/053764

PCT Pub. Date: Apr. 30, 2009

(65) Prior Publication Data

US 2010/0224165 A1 Sep. 9, 2010

(30) Foreign Application Priority Data

Oct. 3, 2007 (HU) ..... 0700643

(51) Int. Cl.
*F02B 53/00* (2006.01)

(52) U.S. Cl.
USPC ..... 123/205; 123/212; 123/214; 418/68; 418/195

(58) Field of Classification Search ..... 123/205, 123/200, 208, 210, 212, 214, 221, 223, 224, 123/225, 227, 228, 230, 231, 241, 243–245, 123/18 R, 18 A, 44 C, 43 B; 418/68, 195
See application file for complete search history.

(56) References Cited

U.S. PATENT DOCUMENTS 2,204,760 A 6/1940 Jensen
2,727,465 A 12/1955 Dutrey
(Continued)

FOREIGN PATENT DOCUMENTS

DE 2619474 A1 2/1977
SU 877129 A1 10/1981

*Primary Examiner* — Mary A Davis
(74) *Attorney, Agent, or Firm* — Birch, Stewart, Kolasch & Birch, LLP

(57) ABSTRACT

The subject of the invention is a variable-volume rotary device with a housing (1) comprising an inner spherical cavity, inlet and exhaust ports and a bypass flow path. Within the housing (1) a rotary displacement member with spherical outer configurations capable of revolving around the center point of the spherical inner surface of the housing is mounted. Said rotary displacement member is equipped with a centrally disposed, disc-shaped partition (6) that forms a mutually isolated division in the spherical inner cavity of the housing (1) and has two pivot vanes (7, 8), splitting the housing cavity further into four isolated quadrants, the volume of which vary during gyration. Vanes (7, 8) are similar in shape to orange segments. Vanes (7, 8) are connected to opposing sides of and along the diameters of the central disc (6), and extend in mutually perpendicular planes, allowing for rotary movement. Inlet- and exhaust ports are arranged on the housing (1) so that, when the rotary displacement member is in motion, the inlet port connects only to a quadrant represented by the smaller spherical projection of the disc (6) within the inner spherical cavity of the housing (1), whereas the exhaust port only meets a quadrant indicated by the larger spherical projection of the disc (6) within the inner spherical cavity of the housing (1).

8 Claims, 12 Drawing Sheets

U.S. PATENT DOCUMENTS 5,127,810 A 7/1992 Kolbinger
5,171,142 A 12/1992 Proglyada
6,241,493 B1 * 6/2001 Turner ..... 418/68
6,325,038 B1 * 12/2001 Millett ..... 123/241
8,152,504 B2 * 4/2012 Didin et al. ..... 123/241

* cited by examiner

VARIABLE-VOLUME ROTARY DEVICE, AN EFFICIENT TWO-STROKE SPHERICAL ENGINE

The subject of the invention is a variable-volume rotary device, an efficient two-stroke spherical engine with an inner spherical cavity and consisting of inlet- and exhaust ports and a bypass flow path. Within the housing, a rotary displacement member with spherical outer configurations and capable of revolving around the center point of the spherical inner surface of the housing is mounted. The casing of the displacement member, mating with the spherical inner surface of the housing, controls the opening and closing of the intake- and exhaust ports as well as the bypass flow path. Said rotary displacement member is equipped with a centrally disposed, disc-shaped partition that forms a mutually isolated division in the housing cavity and has two pivot vanes, splitting the housing cavity further into four isolated quadrants, the volume of which vary during gyration. Within the housing, bearing power take-off shafts, the axis of which cross the center point of the spherical inner surface of the housing, are affixed to said vanes at obtuse angles.

Machines based on the idea of volume variation are well known in technology. A subcategory of these are devices equipped with pistons performing alternating motion and are utilized mostly as internal combustion engines, liquid- or gas pumps, hydro- and air engines. As a result of this alternating motion, pistons and all connected parts are subjected to a great deal of mechanical stress, whereas their pace is uneven.

Of internal combustion engines, the most widespread are two- and four-stroke, alternating piston combustion units. Two-stroke engines, due to their high emissions and fuel consumption have been overshadowed for a long time. The use of four-stroke engines, with respect to their more dynamic operation and higher specific performances, is more favorable. The full work-cycle within a two-stroke engine is performed in one rotation of the main axle, whereas this requires two rotations in a four-stroke engine. That is, each rotation of the main axle represents a full work-cycle in a two-stroke engine, while the same work-cycle in a four-stroke unit requires two axle rotations. A further advantage of the two-stroke engine is that ignition and operation is supported in both directions. As a result of these advantages, especially in the lowest- and highest performance ranges, two-stroke engines are beginning to gather more ground.

To eliminate disadvantages stemming from the alternating movement of the piston, machines operating under the principle of rotary- or spherical piston volume displacement have been developed.

U.S. Pat. No. 2,204,760 refers to a fluid-operated device that can be used as a pump, compressor, rotary engine and the like. When used as a pump, it maintains a steady rate of volumetric flow at identical speeds. When used as an engine, the rotary direction can be changed without altering the device. Within its housing is a spherical chamber, in which a spherical, bearing rotary device is mounted that consists of multiple parts and forms chambers that contract and expand alternately.

U.S. Pat. No. 2,727,465 describes a rotovolumetrical pump. Its housing has a spherical cavity, in, which a spherical rotary device with bearing crankshafts is mounted. The rotary device comprises three spherical parts, where the two outer parts are connected, akin to a universal joint, to a third, inner sphere part.

SU Patent No. 877 129 discloses a rotary displacement pump. Its housing has an inner spherical surface, in which a rotary device comprising several parts is bearing-mounted.

This device constitutes radially extending vanes mounted for axial movement. The purpose of the invention is to improve surface sealing, which is attained by the partial increase in the diametrical plane of the outer surface that comes into contact with the inner surface of the housing.

U.S. Pat. No. 5,171,142 refers to a rotary displacement machine that can be used as an engine or pump, with adjustable output or transmitted flow medium (such as steam, liquid, gas and the like). The invention comprises a casing with spherical interior space that accommodates a rotor formed by a disc-shaped partition and by a pair of vanes, each of which is rigidly secured to a respective power take-off shaft. Both vanes are defined by a mutually shared spherical shape and two planes intersecting each other at an angle and are mounted on the disc mounted for rotation. The disadvantage of this solution is that the disc-shaped element partitions the interior space of the housing into two identical work compartments, thus medium flows at a steady pressure. The apparatus features two inlet- and two exhaust ports, all of which connects, at given angles, with each quadrant of both work compartments when rotary device is in motion. The drawback of this technology is that mediums in different quadrants may amalgamate. If the invention is utilized as an engine, charges cannot be attained. Its efficiency is relatively poor and it has a significantly high emission rate.

The purpose of the invention is the betterment of variable-volume engines to achieve high efficiency levels while becoming less of a threat to the environment.

The variable-volume rotary device described in the introduction reaches this goal by employing the following makeup: the central disc, as an object, is defined by a sphere that corresponds to the inner spherical cavity of the housing and by planes on its other side surfaces. To each of these side surfaces, a spherical projection of different diameter is attached, all being concentric with the inner spherical surface of the housing. Vanes are similar in shape to orange segments with outer surfaces corresponding to the spherical inner surface of the housing and their inner spherical surfaces fit the outer surfaces of spherical projections. In turn, their two side surfaces are defined by planes that intersect each other at a concave angle and cross the center point of the housing. Vanes are connected to opposing sides of and along the diameters of the disc, and extend in mutually perpendicular planes, allowing for rotary movement. Inlet- and exhaust ports are arranged on the housing so that, when rotary displacement member is in motion, the inlet port connects only to a quadrant represented by the smaller spherical projection of the disc within the inner spherical cavity of the housing, whereas the exhaust port only meets a quadrant indicated by the larger spherical projection of the disc. The bypass flow path only connects the housing compartment containing the smaller spherical projection of the central disc with the compartment containing the larger spherical projection.

The variable-volume rotary machine of the invention has a housing with an inner spherical surface. Such housing, due to its advantageous geometrical makeup, can be utilized in the construction of engines or pumps with performances far greater than those of conventional engines. The housing is manufactured in a divided fashion, consisting of at least two parts. If designed effectively, the housing can be assembled from three parts. Similar to conventional engine housings, the external surface may feature heat sinks, in order to improve cooling. The material of the housing can be an aluminum- or steel alloy that is known in the art. Inlet and exhaust ports, as well as the bypass flow path are integrated into the housing. The bearings of the rotary displacement member are fitted in the diameter of the inner spherical surface. Bearing locations may be defined within the 90° to 180° degree range in between axles. In an efficient solution, this angle between the axles connected to the vanes of the rotary displacement member is 135°.

The rotary displacement member consists of three main parts and is constructed as a spherical object with a central disc-shaped partition and two vanes connected to takeoff shafts. The makeup of this rotary displacement member is akin to the universal joint, with the rotary disc being the universal cross and the vanes representing the shafts. The central disc divides the internal space of the housing into two compartments, and the vanes connected to the disc divide these even further, so that the internal cavity of the housing is split into four quadrants during operation. To the vanes, power takeoff shafts—with bearings in the housing—are secured. By rotating these shafts, the central disc and its vanes also start to rotate while the volume of the quadrants alternates between zero and maximum value.

As per the invention, the central disc of the rotary displacement member is constructed as an object defined by a spherical surface and plane surfaces. This spherical surface mates with the inner surface of the housing. The planes can be parallel to one another, but an advantageous design proves that each of these planes should be bound by a pair of planes intersecting at an acute angle. In the case of an even more advantageous execution of the invention, this angle ranges between 160° to 170°. The notion of a plane is used here in a broader-than-usual sense. As such, it does not only refer to actually flat surfaces but concave and convex arched surfaces also, which can be regarded as planes as far as their function is concerned. A spherical projection is mounted to both faces of the central disc, each being concentric and with the same center point as the disc. The radius of these spherical projections is different. In an efficient solution, the ratio of these radiuses is between 1:1.3 and 1:2.0. Another useful version of the invention suggests this radius to be 1:1.5. The central disc and the spherical projections may be construed out of one piece, but the invention includes an adaptation in which the central disc and the spherical projections are manufactured separately and are later bound together using either permanent or releasable joints.

Vanes are connected to opposing sides of and along the diameters of the disc, and extend in a mutually perpendicular plane, allowing for rotary movement. Vanes are similar in shape to orange segments with their outer spherical surfaces mating with the spherical inner surface of the housing and their inner spherical surfaces mating with the outer surfaces of spherical projections. In turn, their two side surfaces are defined by planes that intersect each other at a concave angle and cross the center point of the housing. According to the geometric makeup that ensures the operability of the invention, the inner spherical surface of the housing, the central disc, as well as the spherical projections, all share the same center point. The plane, end fades of vanes, in the context of the invention, do not need to be completely flat surfaces but can be slightly arching concave or convex surfaces also. As per the invention, the plane surfaces of the disc and the vanes must be mating with one another.

Vanes are connected to the central disc on perpendicular axes, allowing for rotary movement. When rotary displacement member is in motion, the faces of the central disc and the end faces of vanes at terminal situations osculate while the volume of quadrants in between them alternates practically between zero and the maximum value. Obviously, complete closure of quadrants, that is, the formation of zero volume must be avoided. Therefore, in order to maintain minimum volume, a minimal gap must be maintained between said surfaces. An advantageous implementation of the invention employs recesses and/or elevations on the faces of the central disc and/or the faces of the vanes.

The material for the rotary displacement member can be a material commonly used in pistons, for example aluminum or steel alloys. To ensure identical thermal expansion values, it is suggested that the housing and rotary displacement member are manufactured from the same material.

Proper sealing between the inner spherical surface of the housing and the rotary displacement member is a fundamental criteria for economic and effective operation. According to an advantageous implementation, sealing between the surface of the rotary displacement member and the inner spherical surface of the housing is provided merely by the finishing of these surfaces. Namely, if mating surfaces are processed with due precision and if identical thermal expansion is guaranteed by competent selection of materials, adequate sealing can be attained without the use of a separate sealant. Another advantageous version of the invention employs a sealant member on the spherical surfaces of vanes and disc, in order to maintain sealing between the inner spherical surface of the housing and the spherical surface of the rotary displacement member.

In order to provide cooling in the central disc and the vanes of the rotary displacement member, narrow cavities containing cooling fluid may be implemented using known methods.

The apparatus specified by the invention may be used as an internal combustion engine and a pump as well. When used as an engine, the variable-volume machine is more advantageous in a two-stroke setup. It can be beneficial as a conventional or injection gasoline engine. In this version, an opening containing the ignition component is built into the chamber represented by the larger spherical projection of the central disc. The invention also enables diesel engine setups. An advantageous implementation employs a fuel inlet that opens into the chamber represented by the larger spherical projection of the central disc.

Drawings of the implemented model assist in describing the invention in more detail.

Figure 4A:
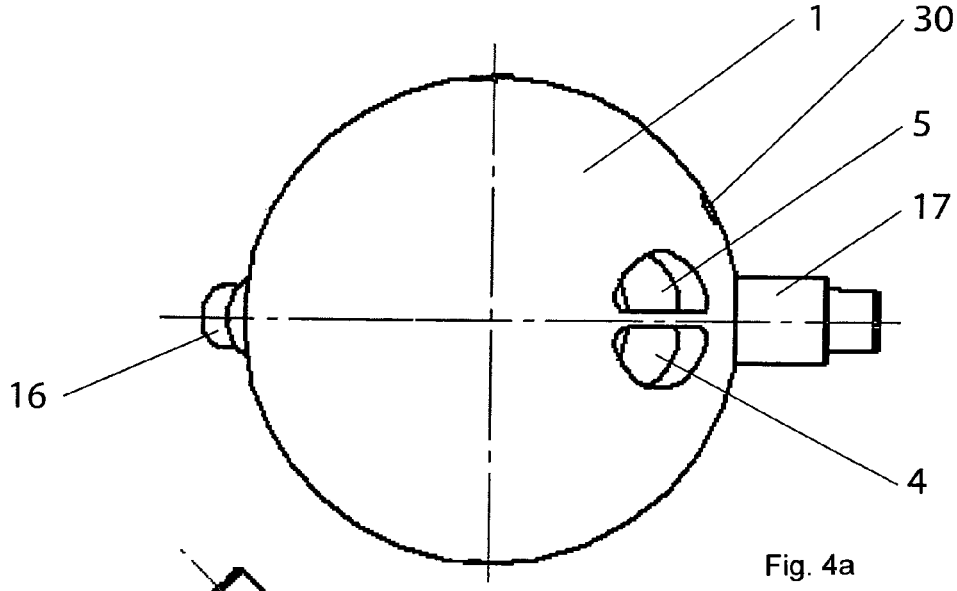
Figure 4B:
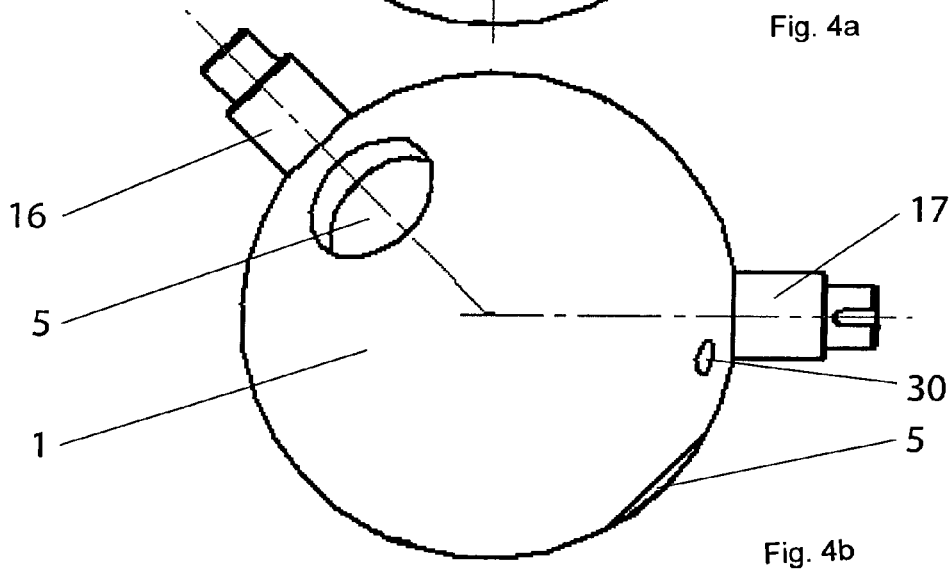
Figure 4C:
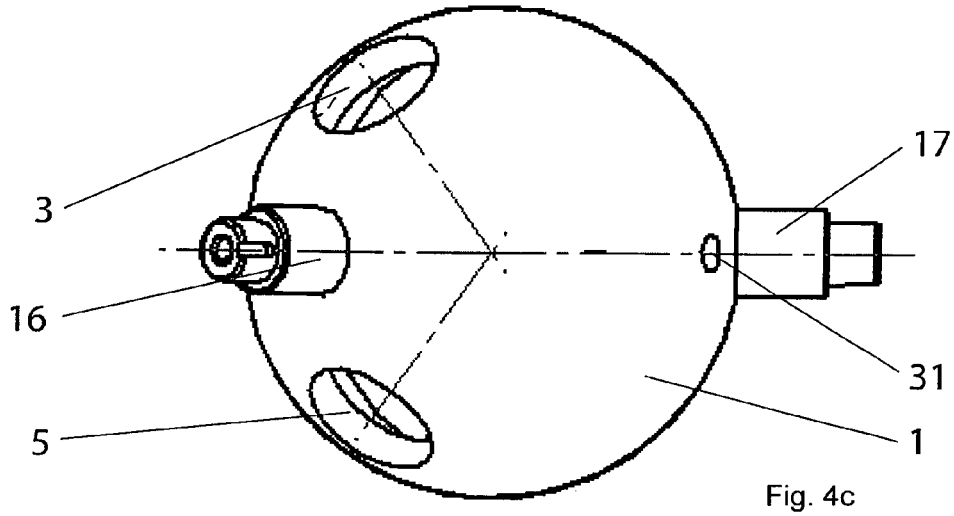

FIGS. 4*a*, 4*b* and 4*c* are schematic representations of the housing from underside, top and front views.

Figure 1:
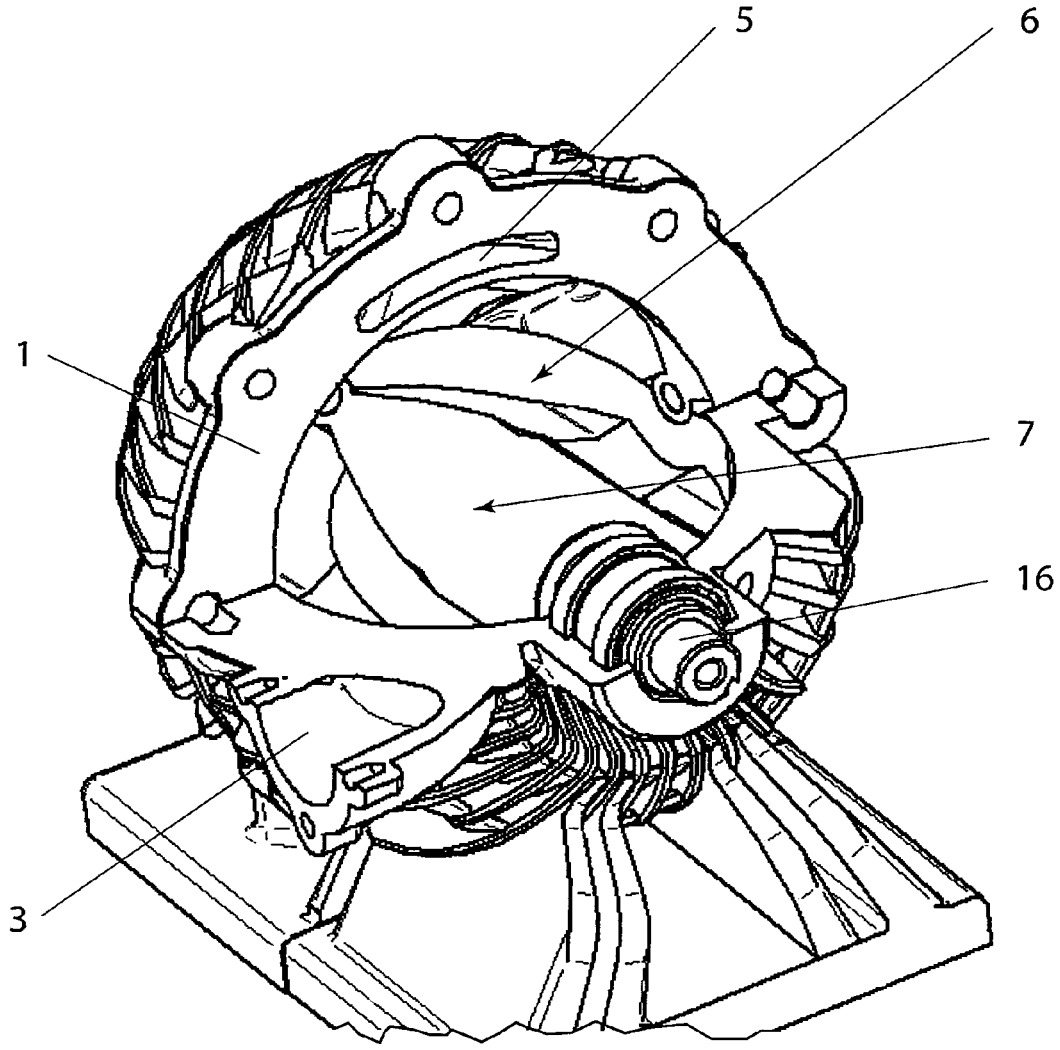
FIG. 1 is the axonometric projection of the variable-volume rotary machine, without certain sections of the housing.

FIGS. 5*a*, 5*b* to 12*a*, 12*b* are used to demonstrate the operational principle for the functioning of the variable-volume rotary machine of FIG. 1.

FIG. 1 represents the invention of the variable-volume rotary machine in the implementation of a two-stroke internal combustion engine. Housing 1 is made in a divided fashion using four parts sealed and fastened to one another with releasable bonding. Housing 1 is manufactured from steel alloy and its outer surface features heat sinks. Housing 1 includes inlet ports 3, exhaust ports 4 and a bypass flow path 5. The inner cavity of housing 1 is formed as a spherical surface, to which a rotary displacement member 2 is attached with bearings. The center point of the outer spherical surface of the multi-part rotary displacement member 2 is identical to that of the inner spherical surface of housing 1. The spherical surface of rotary displacement member 2 mates with the spherical surface of housing 1. Such alignment and tight fitting (H7/h6) of housing 1 and rotary displacement member 2 allow for the sealed gyration of the rotary displacement member.

Figure 2:
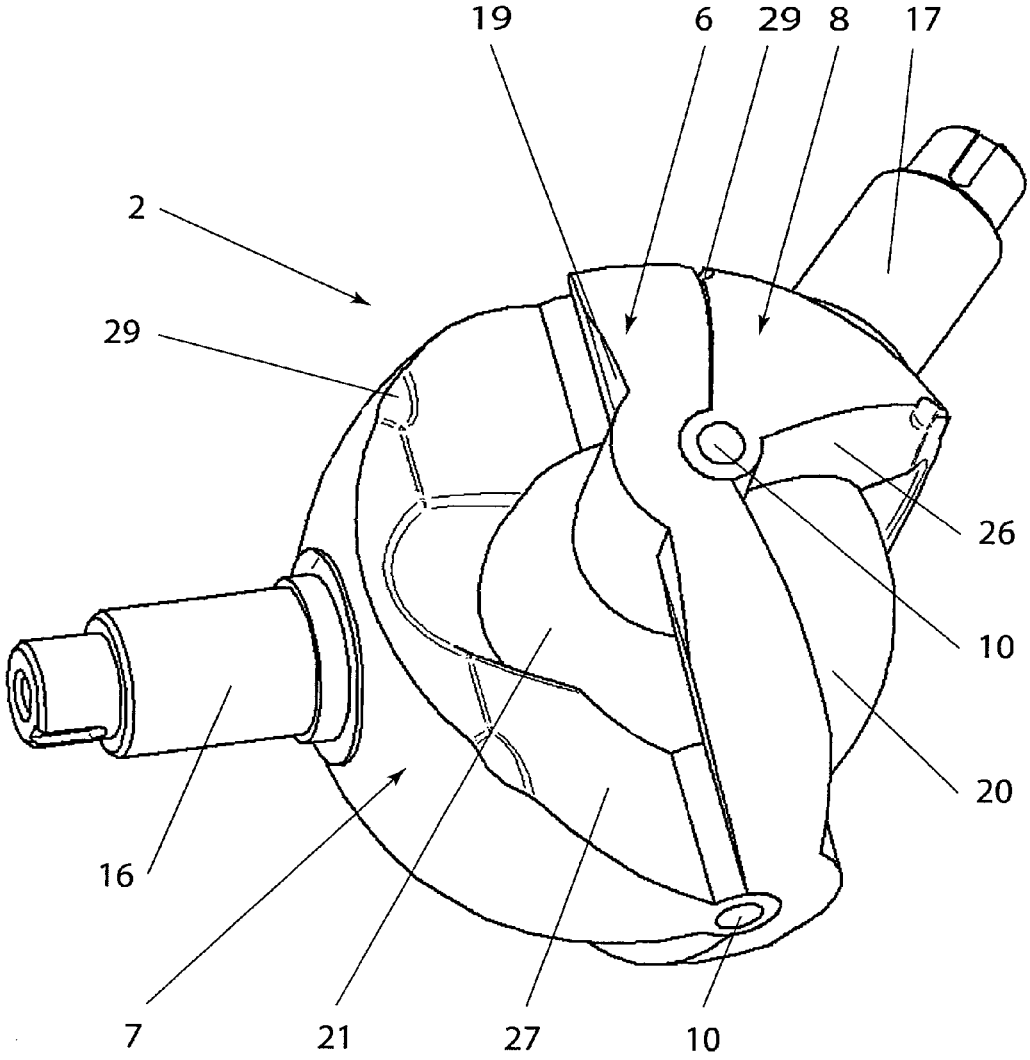
FIG. 2 is the axonometric projection of the rotation device of the variable-volume rotary machine shown on FIG. 1.
Figure 3:
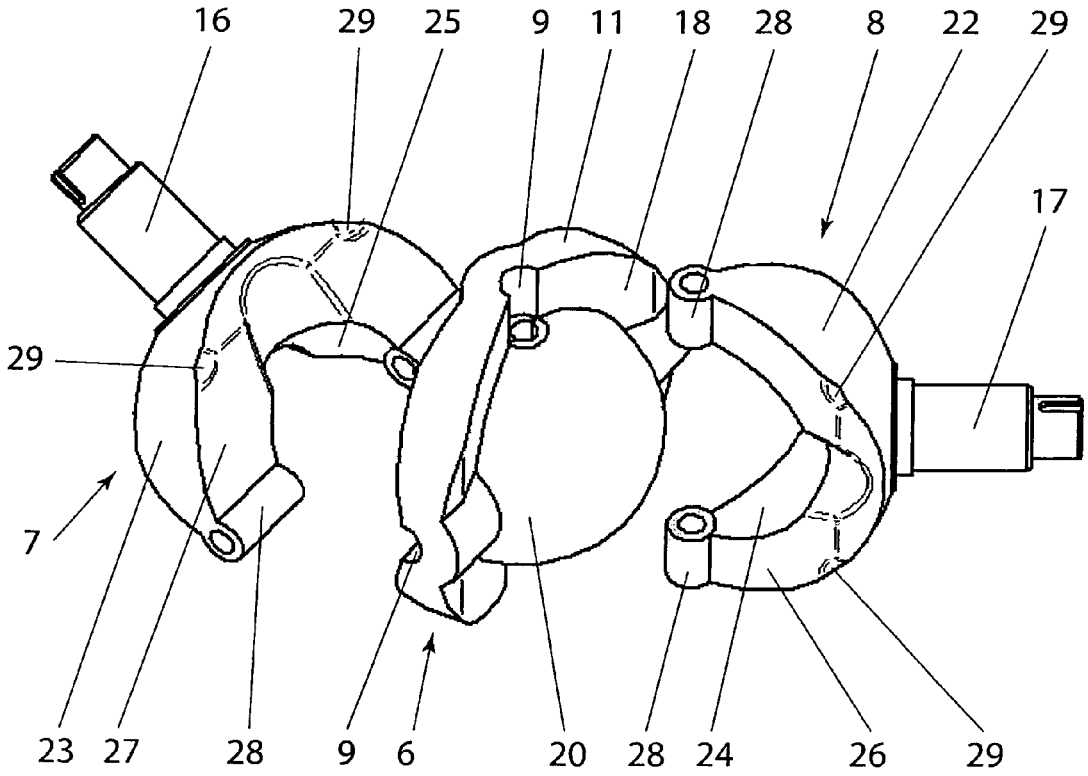
FIG. 3 is the exploded projection of the rotation device.

As seen on FIGS. 2 and 3, rotary displacement member 2 has a central disc 6 to which two rotatable vanes 7 and 8 connected along the diameters of the disc, extending in mutually perpendicular planes, allowing for rotary movement. The central disc 6 divides the inner cavity of housing 1 to two chambers which are further divided by vanes 7 and 8 into quadrants 12, 13, 14 and 15. These quadrants revolve when takeoff shafts 16 and 17 rotate, and their volume alternates constantly.

Central disc 6 features a spherical surface 11 and faces 18 and 19 defined by planes. Affixed to faces 18 and 19 are spherical projections 20 and 21, respectively. Spherical projections 20 and 21 are concentric with outer spherical surface of rotary displacement member 2. The radius of spherical projection 20 is one and a half times that of 21. Quadrants 12, 13, 14 and 15 take up a spherical shape with projections 20 and 21, where the volumes of quadrants 12 and 13 are less than those of 14 and 15.

Vanes 7 and 8 are connected to central disc 6 along the two mutually perpendicular diameters of the disc. Vanes 7 and 8 are similar in shape to orange segments, whose outer spherical surfaces 22 and 23 mate with the inner spherical surface of housing 1 and whose inner spherical surfaces 24 and 25 mate with the outer spherical surfaces of projections 20 and 21. Side surfaces 26 and 27 of vanes 7 and 8 are represented by planes intersecting each other at an acute angle, with the intersection point being—in an assembled stage—the center point of spherical projections 20 and 21. In a constructed stage, this intersection point is the center point of the inner spherical surface of housing 1. The tapering ends of vanes 7 and 8 end in cylindrical connectors 28 that are fitted into the grooves 9 of central disc 6. Vanes 7 and 8 are held in their operating position by pins fastened in central disc 6 and in the custom openings of connectors 28. Pins 10 act as rotational axes for vanes 7 and 8. Rotation is bound by the contact of surfaces 18 and 19 of central disc 6 and surfaces 26 and 27 of vanes 7 and 8. In between the two terminal rotational positions of vanes 7 and 8, volumes of quadrants 12, 13, 14 and 15 alternate between 0 and the maximum value. The side surfaces 26 and 27 of vanes 7 and 8 are fitted with recesses 29. The role of recesses 29 is to prevent the formation of 0 volume, that is, to maintain a minimal gap between the mating of side faces 26 and 27 with surfaces 18 and 19, in order to provide space for the compressed medium in quadrants 14 and 15.

In the symmetry planes of vanes 7 and 8, power take-off shafts 16 and 17 are connected to spherical surfaces 22 and 23. Bearings of shafts 16 and 17 are secured in housing 1 in a way that they form a 135° angle. By the rotation of shafts 16 and 17, the rotary displacement member 2 as well as its central disc 6 and vanes 7 and 8 start rotating as well, meanwhile the volumes of quadrants 12, 13, 14 and 15 continuously alternate.

FIGS. 4*a* to 4*c* are schematic representations of housing 1 in three different views, indicating the alignment of inlet ports 3, exhaust ports 4 and bypass flow path 5 relative to one another. For it is indeed the core idea of the invention that, during the rotation of member 2, quadrants 12, 13, 14 and 15 are mated with inlet ports 3, exhaust ports 4 and bypass flow path 5 in a way that air intake, air bypass flow, injection, combustion and exhaustion are conducted in separate quadrants. Besides the volume fluctuation of quadrants 12, 13, 14 and 15, vanes 7 and 8 control the opening and closure of inlet ports 3, exhaust ports 4 and bypass flow path 5. Air drawn in through inlet ports 3 is sent to quadrants 12 and 13, which act as the crankcases of conventional piston engines. Air drawn into quadrants 12 and 13 is sent to quadrants 14 and 15 via bypass flow path 5. Since the radius of spherical projection 21 in quadrants 14 and 15 is greater than that of projection 20 in quadrants 12 and 13, the air passing through flow path 5 gets pre-compressed whilst being transferred to the spherical section of a smaller radius. In the proximity of the outlet of bypass flow path 5 is the injector nozzle 30 of housing 1, through which fuel is sprayed to form a fuel-air mixture. Spark plug 31 is threaded into housing 1 in a way that spark ignition takes place when quadrants 14 and 15 are experiencing near-zero volume conditions.

Figure 5A:
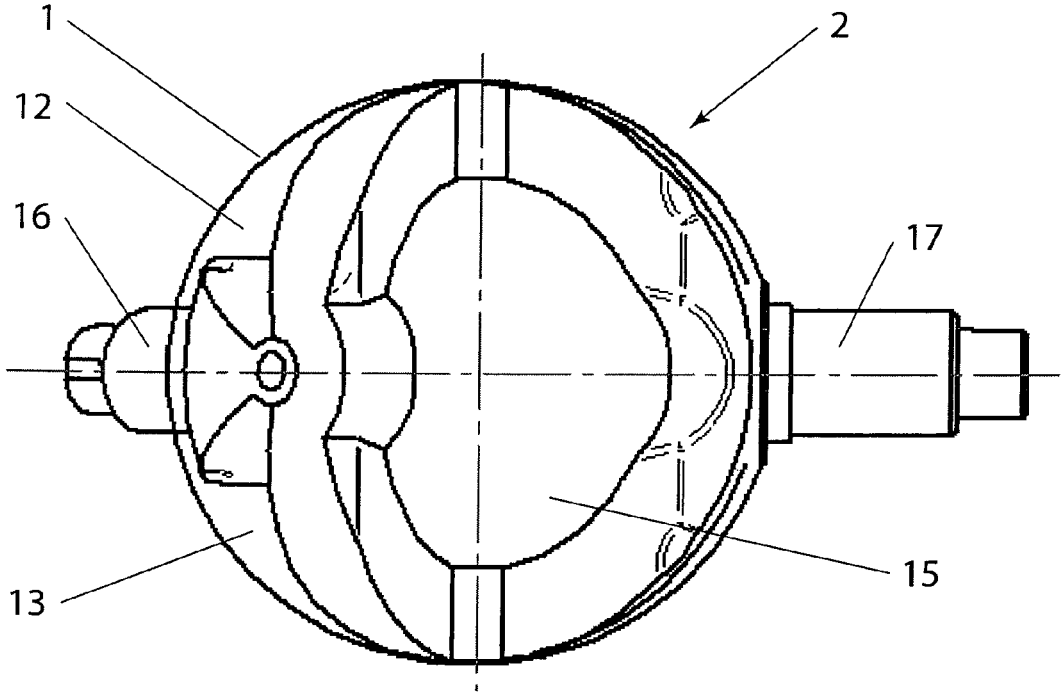
Figure 5B:
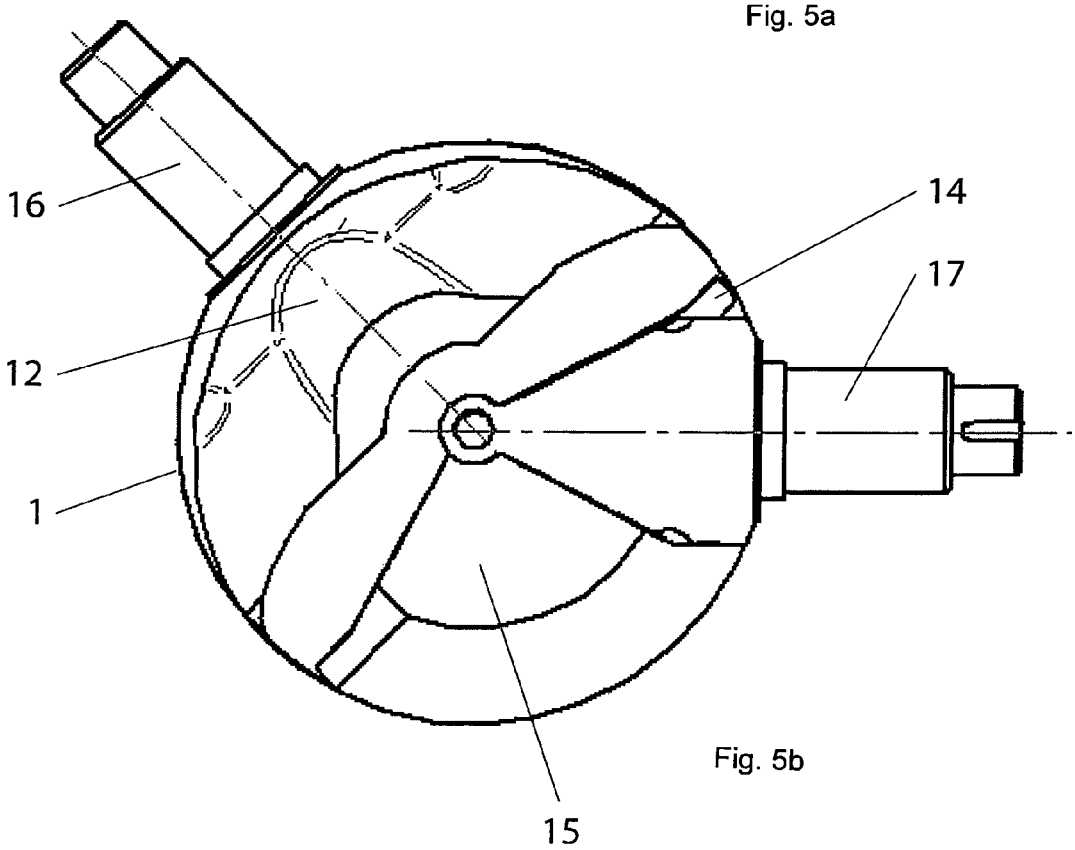
Figure 6A:
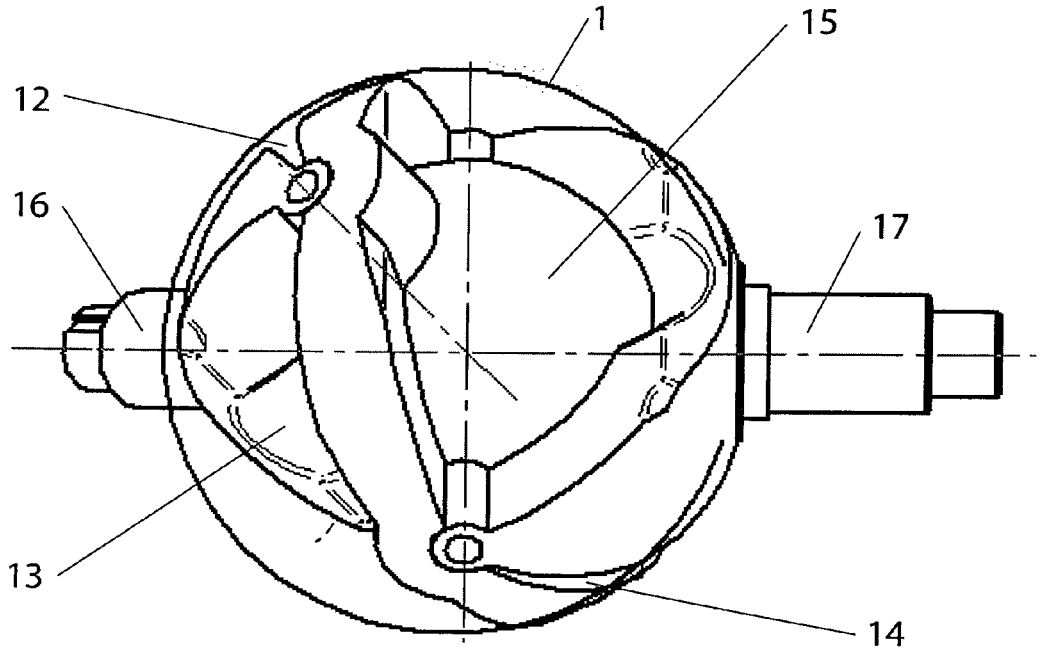
Figure 6B:
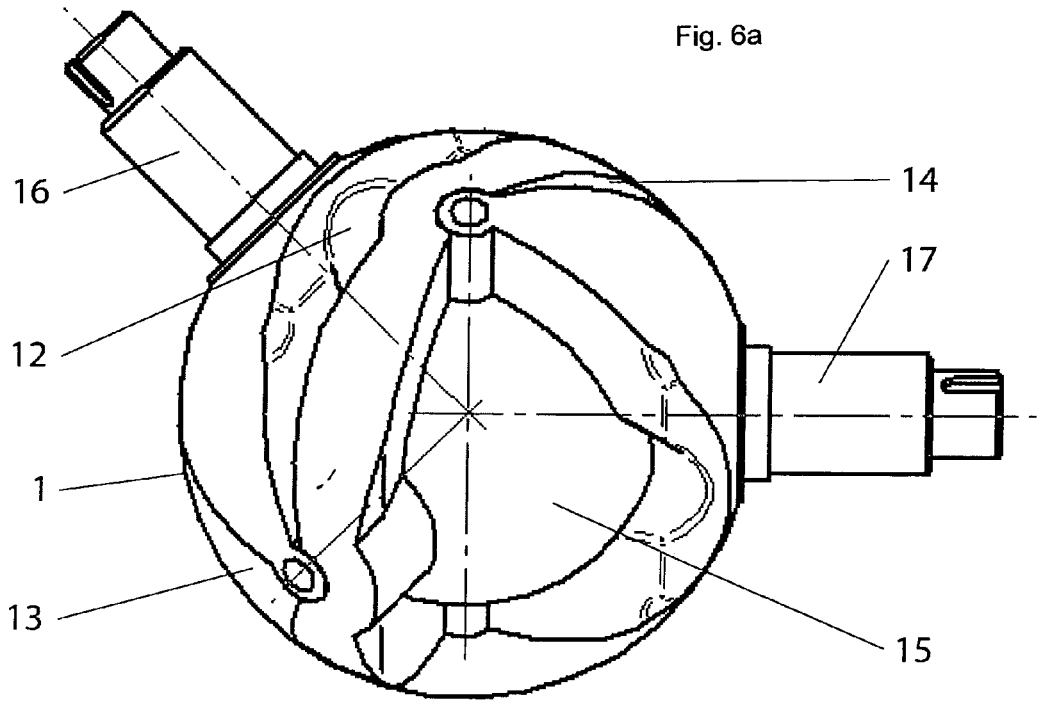
Figure 7A:
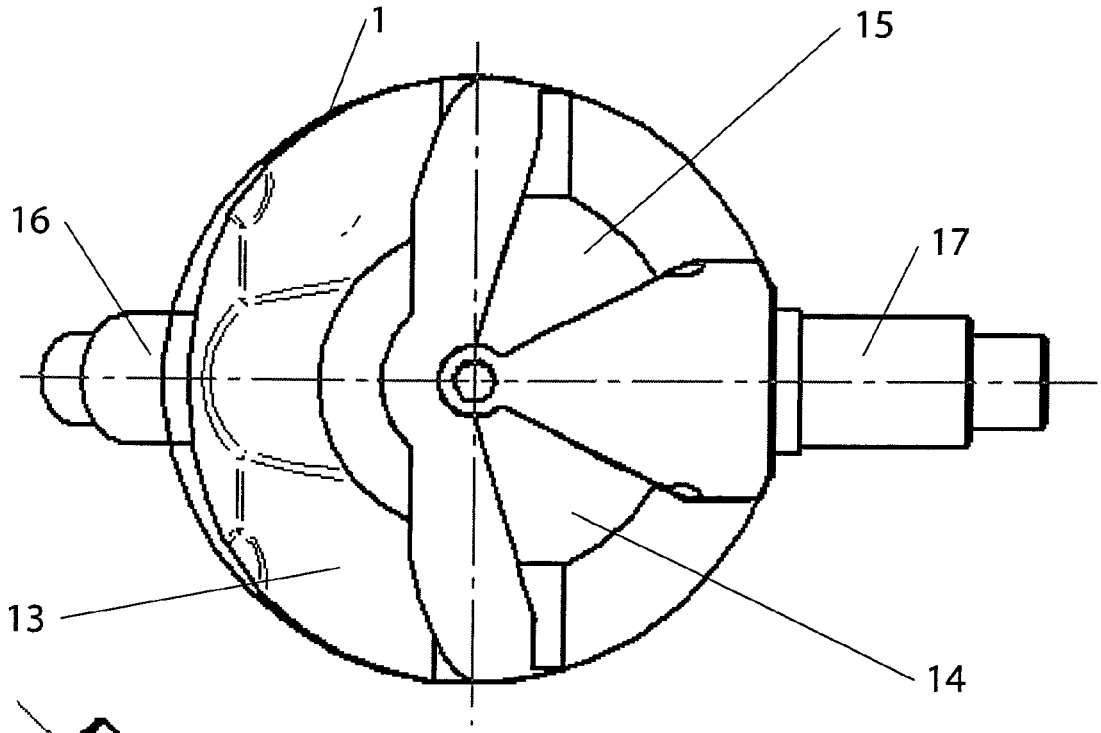
Figure 7B:
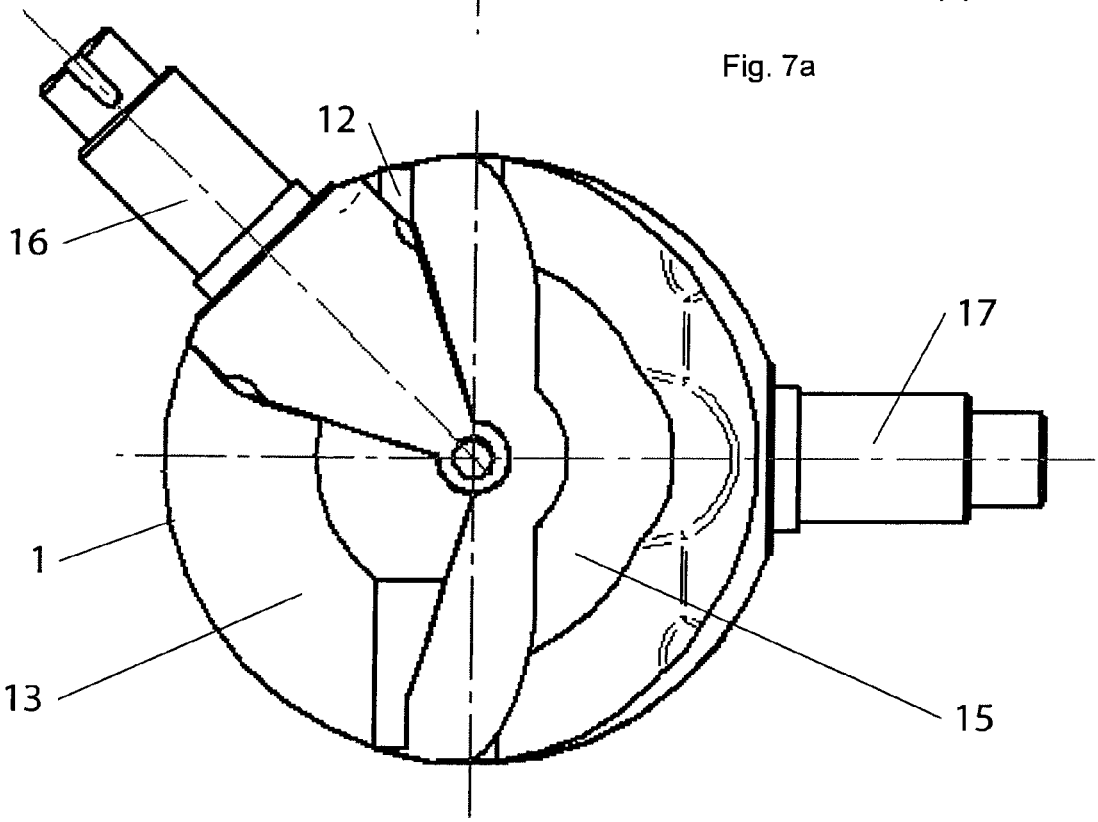
Figure 8A:
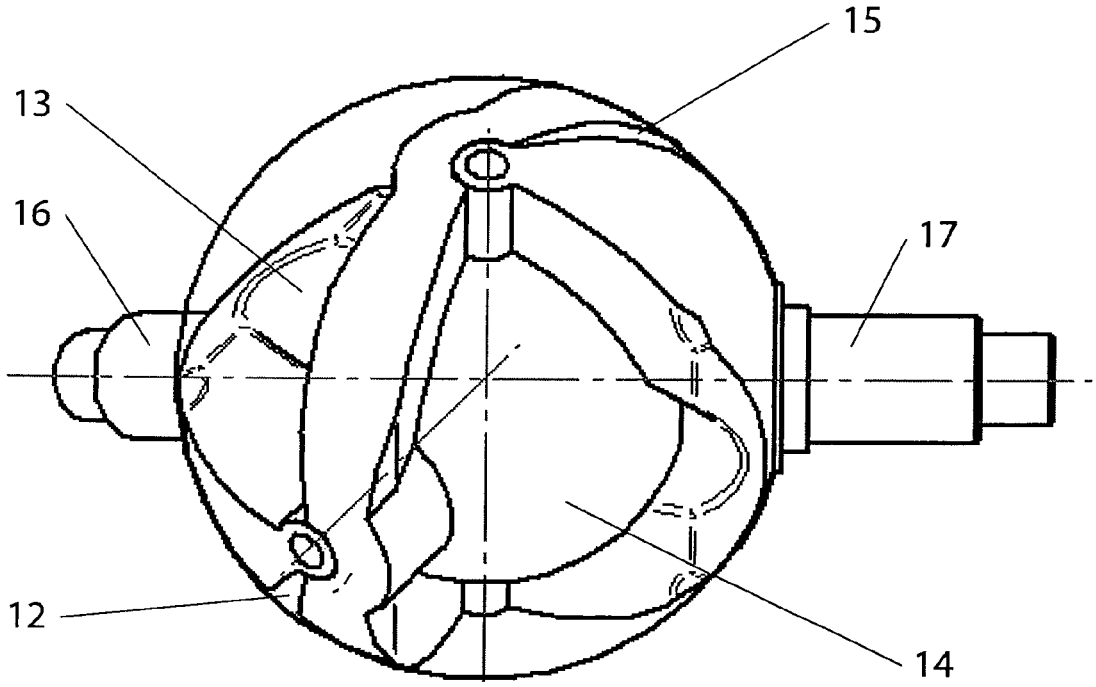
Figure 8B:
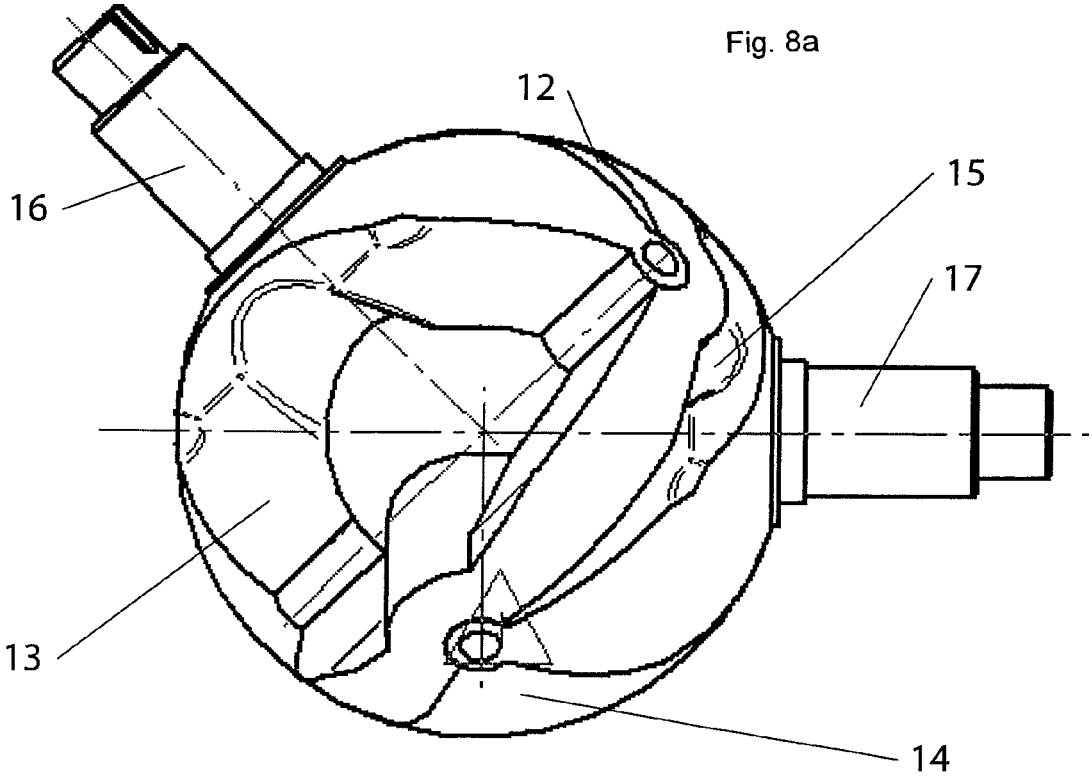
Figure 9A:
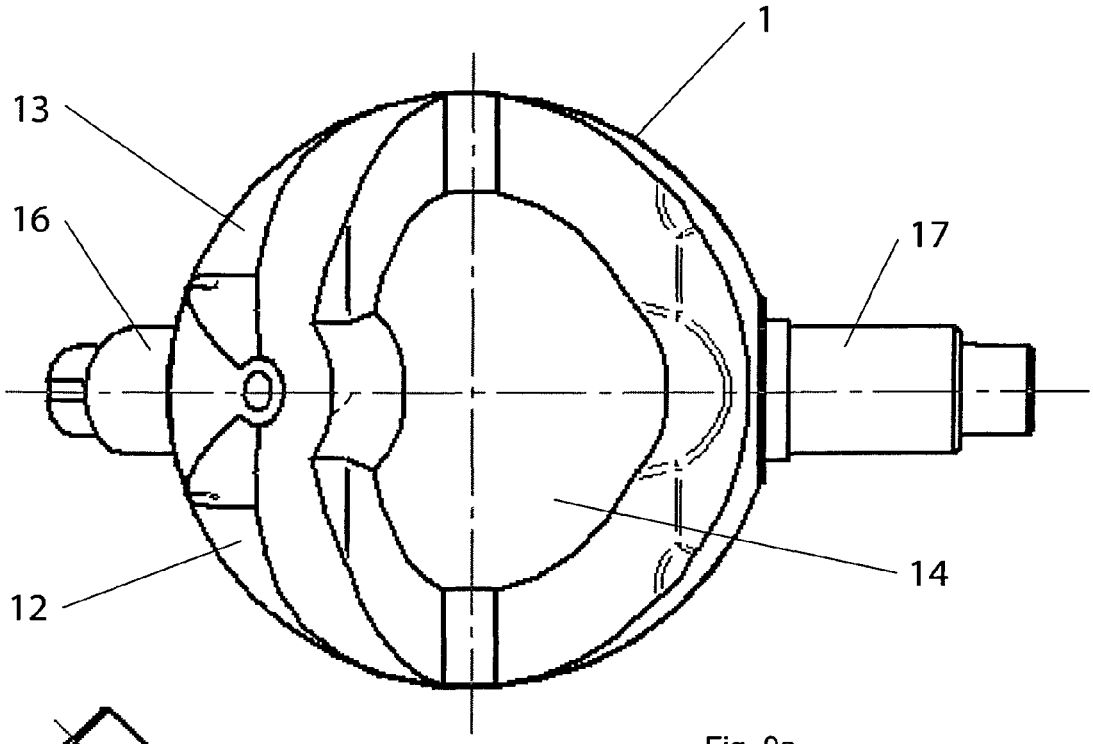
Figure 9B:
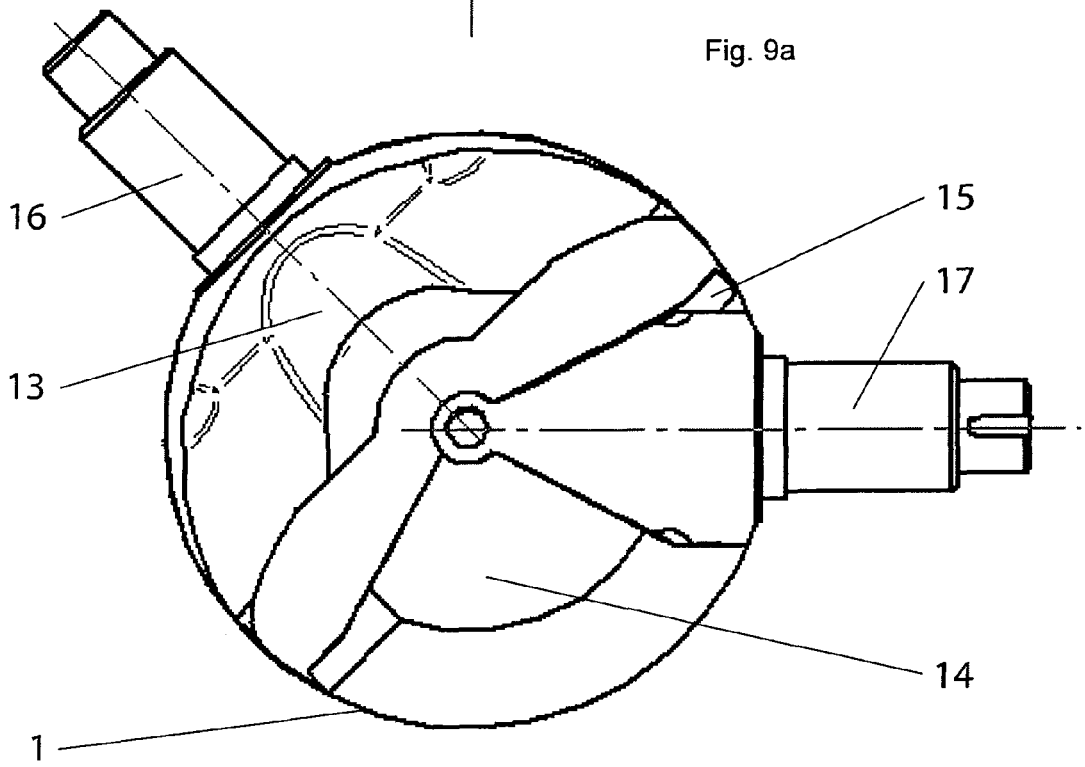
Figure 10A:
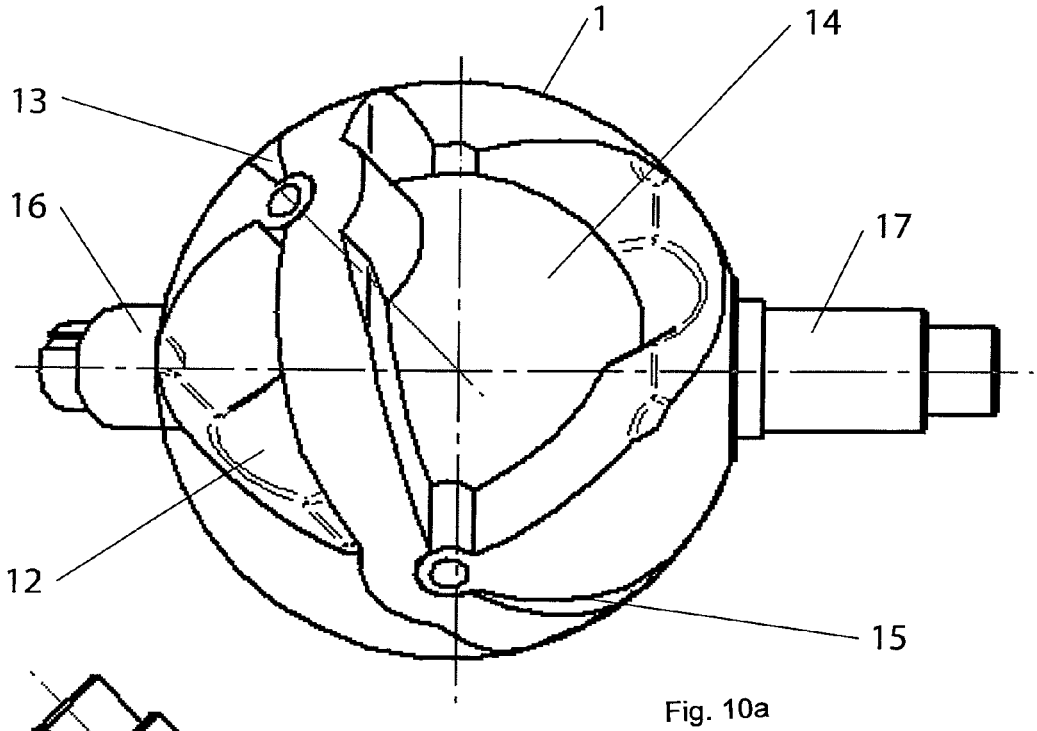
Figure 10B:
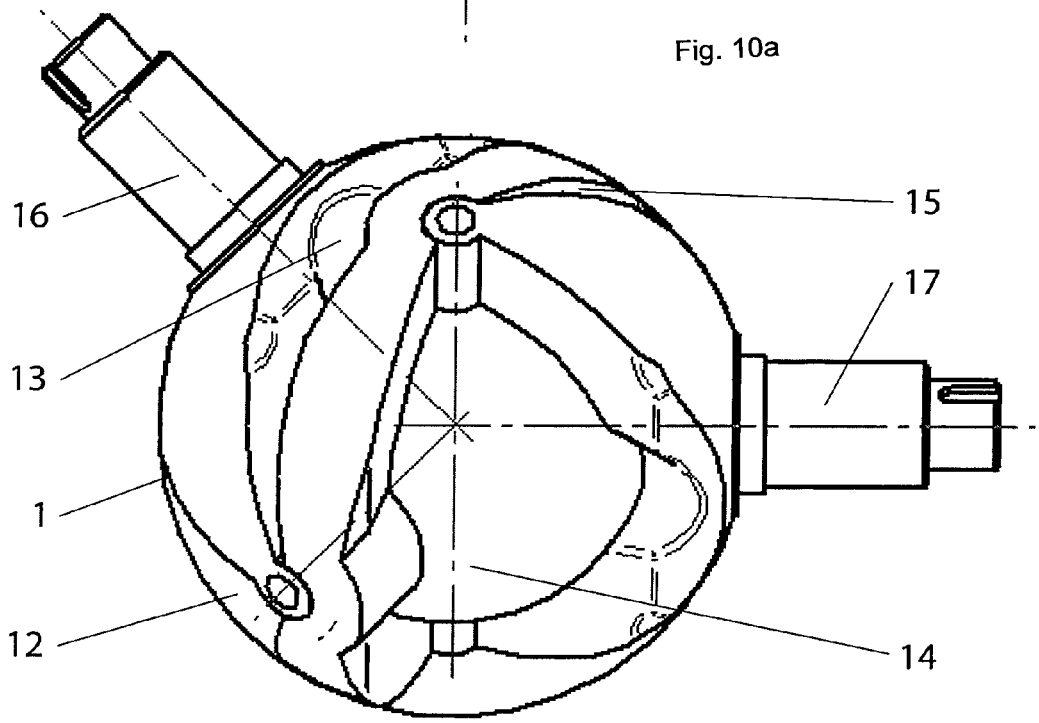
Figure 11A:
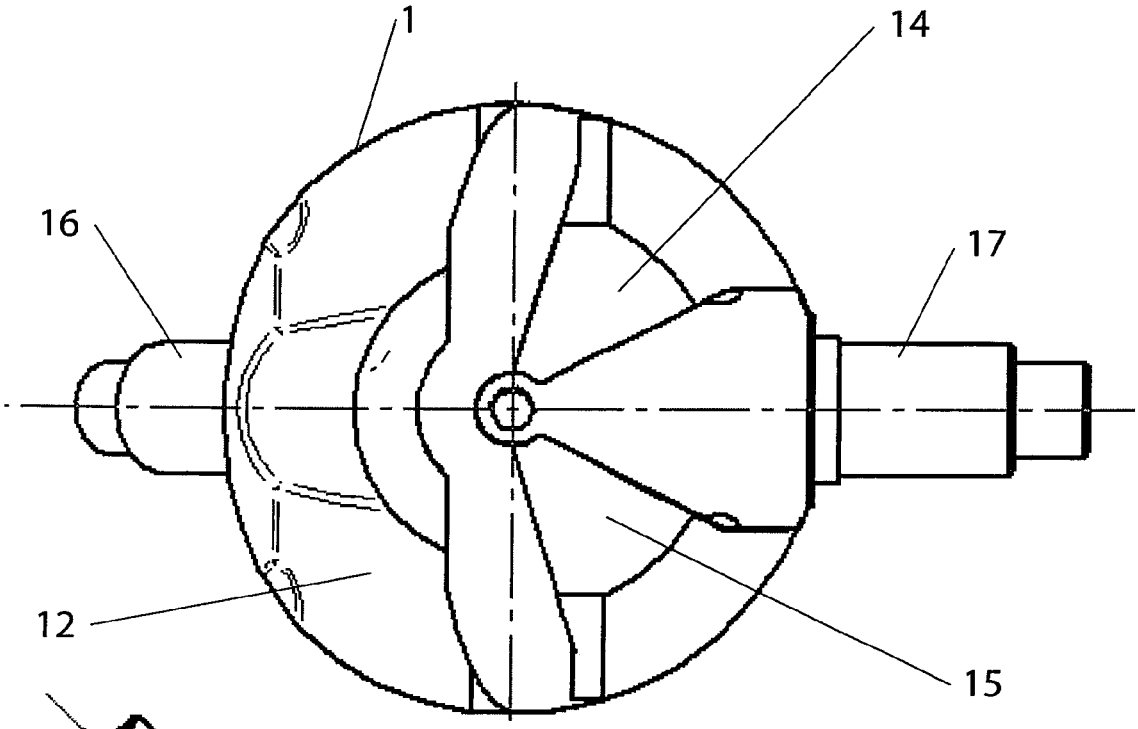
Figure 11B:
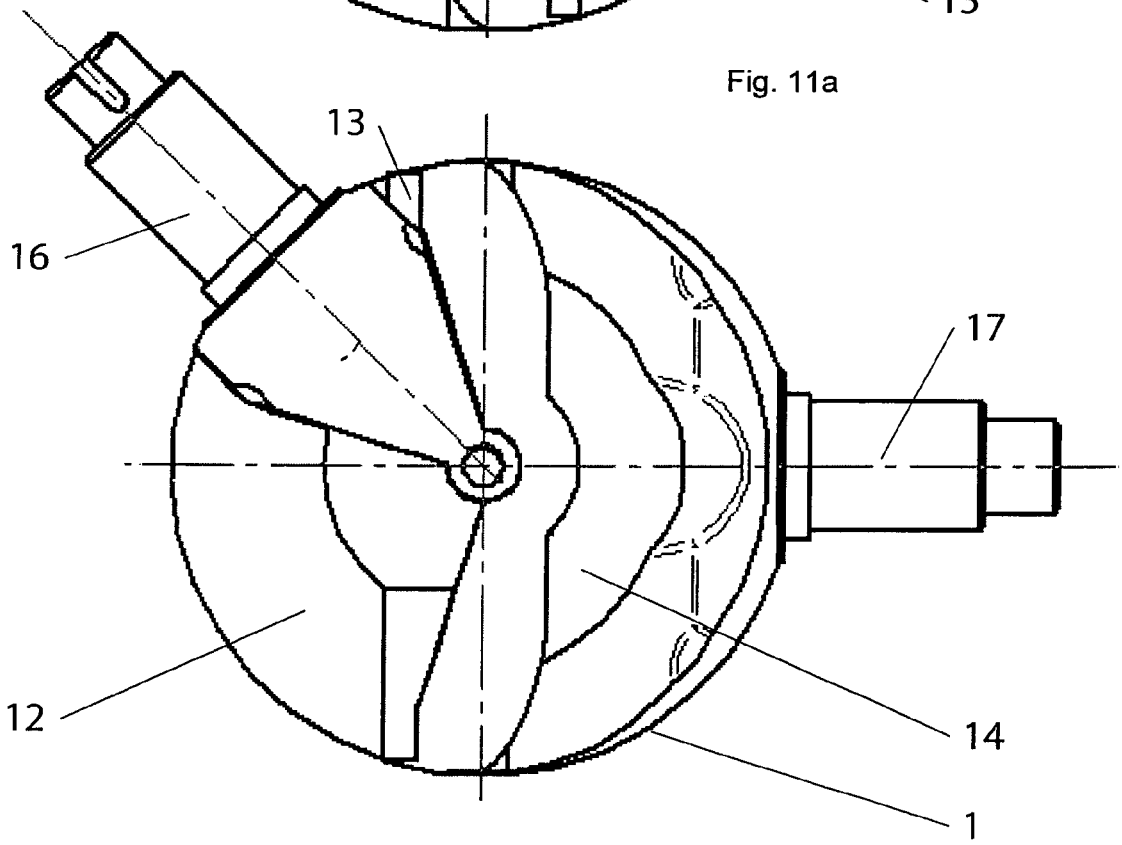
Figure 12A:
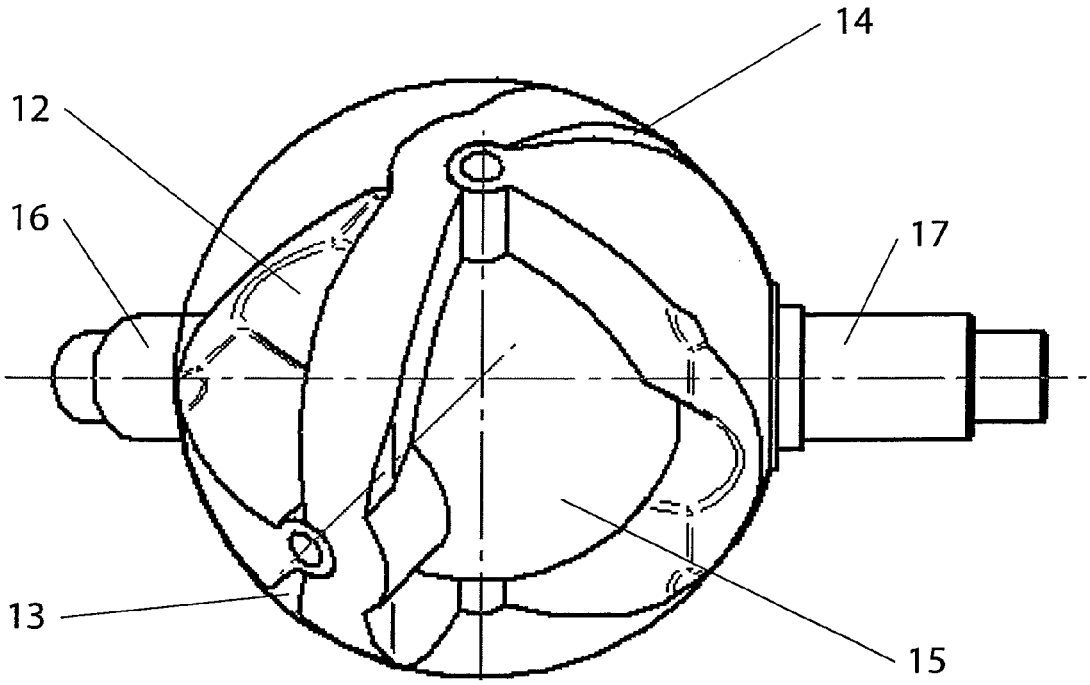
Figure 12B:
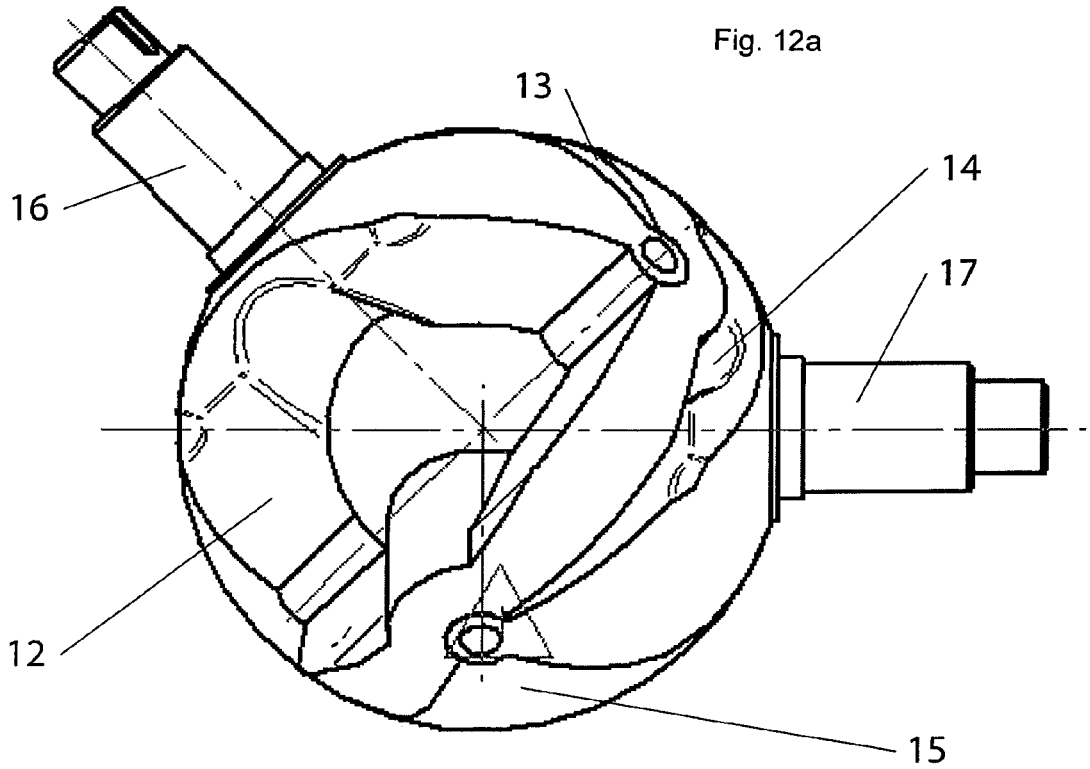

With the help of FIGS. 5*a*, 5*b* to 12*a*, 12*b*, the operational principle of the engine is demonstrated. In these Figures, top- and front views for housing 1 and rotary displacement member 2 are shown in dotted lines, indicating only those details that are indispensable for comprehending the operation of the engine. FIGS. 5*a* and 5*b* show the rotary displacement member 2 in its initial position. The quadrant with the smallest volume is 14, the one with the largest is 15; 12 and 13 are equally moderately sized. FIGS. 6*a* and 6*b* show the engine and takeoff shaft 17 being rotated clockwise at a 45-degree angle. At this moment, volumes of quadrants 13 and 14 are increasing while 15 and 12 are diminishing. On FIGS. 7*a* and 7*b* the apparatus is shown with shaft 17 being turned an additional 45-degrees. In this position, quadrant 14 continues to increase, quadrant 15 decreases and the two become equal. The volume of quadrant 12 is the smallest, whereas quadrant 15 takes up the greatest volume. FIGS. 8*a* and 8*b* depict the situation after another 45-degree rotation of shaft 17. In this position, quadrant 14 is still increasing, 15 starts to shrink. Quadrant 12 is beginning to grow from its previous near-zero volume, whereas quadrant 13 starts to contract. FIGS. 9*a* and 9*b* represent the scenario after yet another 45-degree rotation on shaft 14. Quadrants 15 and 14 have reached their smallest- and greatest volumes, respectively. Quadrants 13 and 12 are both of medium sized. By rotating shaft 17 another 45 degrees, FIGS. 10*a* and 10*b* illustrate how quadrant 15 is growing while 13 and 14 are contracting. Quadrant 12 is also on the expanding side. By turning shaft 17 yet another 45 degrees, quadrant 15 continues to expand, 14 to contract so they become of equal volume. Here, quadrant 13 is the smallest and 12 is the largest, as can be seen on FIGS. 11*a* and 11*b*. Finally, after having rotated shaft 17 another 45 degrees, FIGS. 12*a* and 12*b* show that quadrant 15 continues to grow and 14 is diminishing. Quadrant 13 breaks with its near-zero volume status and begins to expand, whereas quadrant 12 does the opposite—its volume starts to shrink. By further rotating shaft 17 from this stage, the scenario depicted on FIGS. 5*a* and 5*b* arises.

The advantages of the invention are that it can be extensively used in a large number of applications and can help in constructing a compact size engine with a favorable performance/weight ratio.

TABLE OF REFERENCES

1 housing
2 rotary displacement member
3 inlet port
4 exhaust port
5 bypass flow path.
6 central disc
7 vane
8 vane
9 groove
10 pin
11 spherical disc surface
12 quadrant

13 quadrant
14 quadrant
15 quadrant
16 power take-off shaft
17 power take-off shaft
18 disc face
19 disc face
20 larger spherical projection
21 smaller spherical projection
22 outer spherical surface of vane
23 outer spherical surface of vane
24 inner spherical surface of vane
25 inner spherical surface of vane
26 vane side surface
27 vane side surface
28 cylindrical connector
29 recess
30 injector nozzle
31 spark plug

The invention claimed is:

1. Variable-volume rotary device, an efficient two-stroke spherical engine with an inner spherical cavity and comprising of inlet and exhaust ports and a bypass flow path, within the housing, a rotary displacement member with spherical outer configurations and capable of revolving around the center point of the spherical inner surface of the housing is mounted, the casing of the displacement member, mating with the spherical inner surface of the housing, controls the opening and closing of the intake and exhaust ports as well as the bypass flow path, said rotary displacement member is equipped with a centrally disposed, disc-shaped partition that forms a mutually isolated division in the housing cavity and has two pivot vanes, splitting the housing cavity further into four isolated quadrants, the volume of which vary during gyration, within the housing, bearing power take-off shafts, the shaft axes of which cross the center point of the spherical inner surface of the housing, are affixed to said two pivot vanes at obtuse angles comprising a central rotary disc defined on one side by a sphere mating with the inner spherical surface of the housing, and on other sides by two planes, to each of these sides a larger spherical projection and a smaller spherical projection concentric to the inner spherical surface of the housing and of different radii are attached, the two pivot vanes are similar in shape to orange segments with outer surfaces corresponding to the spherical inner surface of the housing and their inner vane spherical surfaces mate with the outer surfaces of the larger spherical projection and the smaller spherical projection, in turn, their two side surfaces are defined by planes that intersect each other at an acute angle and cross the center point of the housing, the two pivot vanes being connected to the central rotary disc on its opposing sides and along its mutually perpendicular diameters, allowing for rotary movement, inlet and exhaust ports being arranged such that, while the rotary displacement member is in motion, the inlet port only connects to a quadrant of the inner spherical cavity of the housing defined by the smaller spherical projection of the central rotary disc, whereas the exhaust port is connected only to a quadrant of the inner spherical cavity of the housing that is defined by the larger spherical projection of the central rotary disc, the bypass flow path being connected to the compartment of the inner spherical cavity of the housing defined by the smaller spherical projection of the smaller radius of the central rotary disc with the compartment of the inner spherical cavity of the housing defined by the larger spherical projection of the larger radius of the central rotary disc.

2. The variable-volume rotary device according to claim 1 wherein the bearing power take-off shafts connected to the two side surfaces of the two pivot vanes of the rotary displacement member forming a 135° angle.

3. The variable-volume rotary device according to claim 1 wherein a radius ratio between the smaller spherical projection and the larger spherical projection is of 1:1.5.

4. The variable-volume rotary device according to claim 1 wherein recesses and/or elevations on the faces of the central rotary disc and/or the faces of the two pivot vanes, in order to avoid zero clearance osculation of these surfaces.

5. The variable-volume rotary device according to claim 1 wherein with sealing between the surface of the rotary displacement member and the inner spherical surface of the housing provided merely by the precision finishing of these surfaces.

6. The variable-volume rotary device according to claim 1 wherein a sealant member on the spherical surfaces of the two pivot vanes and central rotary disc, maintains sealing between the inner spherical surface of the housing and the spherical surface of the rotary displacement member.

7. The variable-volume rotary device according to claim 1 wherein a spark plug is mounted in the compartment of the housing defined by the larger spherical projection of the central rotary disc.

8. The variable-volume rotary device according to claim 1 wherein an injector nozzle is present in the compartment of the housing defined by the larger spherical projection of the central rotary disc.

* * * * *